United States Patent [19]

Murdoch

[11] Patent Number: 4,879,858

[45] Date of Patent: Nov. 14, 1989

[54] METHOD OF INSTALLING A BATHING VESSEL

[75] Inventor: Ian S. Murdoch, N. Humberside, England

[73] Assignee: American Standard Inc., New York, N.Y.

[21] Appl. No.: 176,481

[22] Filed: Mar. 7, 1988

[30] Foreign Application Priority Data

May 3, 1987 [GB] United Kingdom ..... 8705115

[51] Int. Cl.[4] ..... E04F 19/02; E04G 21/00

[52] U.S. Cl. ..... 52/741; 52/35; 4/584; 4/595

[58] Field of Search ..... 52/34, 35, 741; 4/584, 4/592, 593, 595, 584; 403/205, 231, 382, 403

[56] References Cited

U.S. PATENT DOCUMENTS

| | | | |
|---|---|---|---|
| 2,031,255 | 2/1936 | Deubelbeiss | 52/35 |
| 2,143,034 | 1/1939 | Sakier | 52/35 |
| 3,134,197 | 5/1964 | McColley | 52/35 |
| 4,036,149 | 7/1977 | White | 403/205 |
| 4,290,154 | 9/1981 | Benjamin | 4/584 |
| 4,570,406 | 2/1986 | DiFazio | 52/656 |

FOREIGN PATENT DOCUMENTS

| | | |
|---|---|---|
| 1683112 | 10/1969 | Fed. Rep. of Germany . |
| 3318116 | 11/1984 | Fed. Rep. of Germany . |
| 3430700 | 1/1986 | Fed. Rep. of Germany . |

*Primary Examiner*—James L. Ridgill, Jr.
*Attorney, Agent, or Firm*—John P. Sinnott

[57] ABSTRACT

A method of installation, in sealed relationship against at least one vertical wall, a bathing vessel of the type having a sump to contain water therein and a water drain outlet, the bathing vessel including a horizontal rim extending away from the sump and a horizontal rim extending away from the sump and a depending skirt formed around the horizontal rim, positioned relative to a sealing strip assembly, is disclosed.

1 Claim, 2 Drawing Sheets

METHOD OF INSTALLING A BATHING VESSEL

BACKGROUND OF THE DISCLOSURE

1. Field of the Invention

This invention relates to a method of installing a bath or shower-tray against a wall or against two or more walls, in which a seal is provided between the bath or shower-tray edge(s) and the adjacent wall(s) to prevent water getting under the bath or tray; and to a bath when so installed; and to a kit for such an installation.

2. Description of Prior Art

Hitherto, baths and shower-trays have been mounted on or attached to the floor and are held against the wall by perhaps one or two brackets. A settable rubber or plastics sealant or other sealing element is then run along the edge of the bath or tray to seal the gap between it and the wall. In time, with shrinkage or settlement, or continued slight movement each time the installation is used, the seal tends to crack and open. Also, with walls which are not entirely flat, the gap to be sealed on installation can vary in width quite markedly, making sealing rather difficult.

SUMMARY OF THE INVENTION

According to the present invention, there is provided a method of installing a bath or shower-tray in sealed relationship against a wall of a room, comprising providing on a frame member located along a side of the bath or shower-tray under the edge thereof, a strip that extends along the entire side of the bath or tray to be sealed against the wall, which strip includes an intermediate flange portion the width of which is sufficient to bridge the gap from the bath or tray edge to the adjacent wall and a longitudinally continuous upstanding flange portion which projects above the rim of the bath or shower-tray and, then, with the bath or shower-tray in position, fastening that upstanding flange portion at several positions along the length of the strip to the adjacent wall.

The strip, which may be of aluminum or other metal or of plastics, may be fastened to the wall by its upstanding flange, i.e. upstand, so as to support part of the weight of the bath or shower-tray in use, though it could be completely non-load-supporting. The upstand may be fastened to the wall at as many points as required, for example, by simply drilling it wherever appropriate for wall fixation. The continuous upstand facilitates, in particular, drilling in register with wall features such as the wall studs or internal frame of a plasterboard wall, so that a completely rigid support may be effected. The upstand could be pre-drilled at intervals to save drilling on site.

Where the wall above the level of the bath or shower-tray is to be covered with a wallcovering material such as tiling, then the upstanding flange portion of the strip may be recessed into the wall to provide a flat ground surface.

In order to prevent water from entering any gap between the strip and the bath or tray edge, a sealing compound, or possibly a sealing element, may be inserted in that gap. If other tiles or other surface covering is applied to the wall, a further run of sealing compound or element may be inserted between the bath or tray and the tiles or other covering material. Thus, water would be prevented from seeping down to beneath the bath or tray by the two barriers: the outer seal, which would be visible, between the bath or tray and the finished wall surface, and the inner seal between the upstanding flange portion and the bath or tray edge.

Advantageously, the arrangement of the frame and strip and the first seal between the bath or tray edge and the upstand is such that the effect of applying a load to the bath or tray set up in this way, e.g., by filling it with water and/or by an occupant, is to put the seal into compression by the flexure of the strip or possibly of the bath or tray itself, in which case a perfectly watertight joint will be maintained during actual use. Furthermore, because of the continuous upstand, the bath or tray can be securely fastened to the wall in as many places as should prove necessary to prevent any possible movement between the bath or tray and the tile or wallcovering to ensure that the outer seal remains unbroken.

The strip is preferably of uniform cross-section along its length, the intermediate flange portion being continuous also, and there may be a further flange portion where the strip is attached to the frame. Thus, the strip may be L-shaped, or the mirror image, in section, the horizontal limb being arranged with its edge under the frame member of the bath or tray and the remainder constituting the intermediate flange portion, and the vertical limb constituting the upstand, or the strip may be double angled, having a downwardly projecting flange which can be secured by screws passing into the side of a wooden baton frame member.

The frame member is usually of wood but other materials could be used, such as steel, aluminum or plastics. The strip would be secured to the frame member by an appropriate means corresponding to the materials of those parts. A specially shaped strip may be used for this purpose. As an alternative possibility, particularly where the frame and strip are of aluminum for example, they could be integral with each other, manufactured as a unitary extrusion.

Where the bath or tray has straight edges and it is to be arranged against two or more mutually perpendicular walls, similar strips are secured under the edges of the corresponding sides or edges of the bath or tray. The adjacent ends of the strips, where they meet at a corner, may be appropriately mitered and the corner joint sealed with a sealing compound or element. Alternatively, square ended strips may simply be abutted to one another at right angles and a specially shaped corner piece for example, of molded plastics, inserted in the gap between the walls.

Conceivably, if a bath or tray with a curved side is to be fitted to a similarly curved wall, a curved strip in accordance with the invention could be used.

The upstanding flange may be provided with its own cover or trim and/or sealing strip to fair onto the bath or tray edge or otherwise to provide an attractive transition between the bath or tray and the wall, and/or an effective outer seal.

BRIEF DESCRIPTION OF THE DRAWINGS

The invention may be put into effect in a number of ways but one specific embodiment will now be described, by way of example, with reference to the drawings in which.

Figure 1:
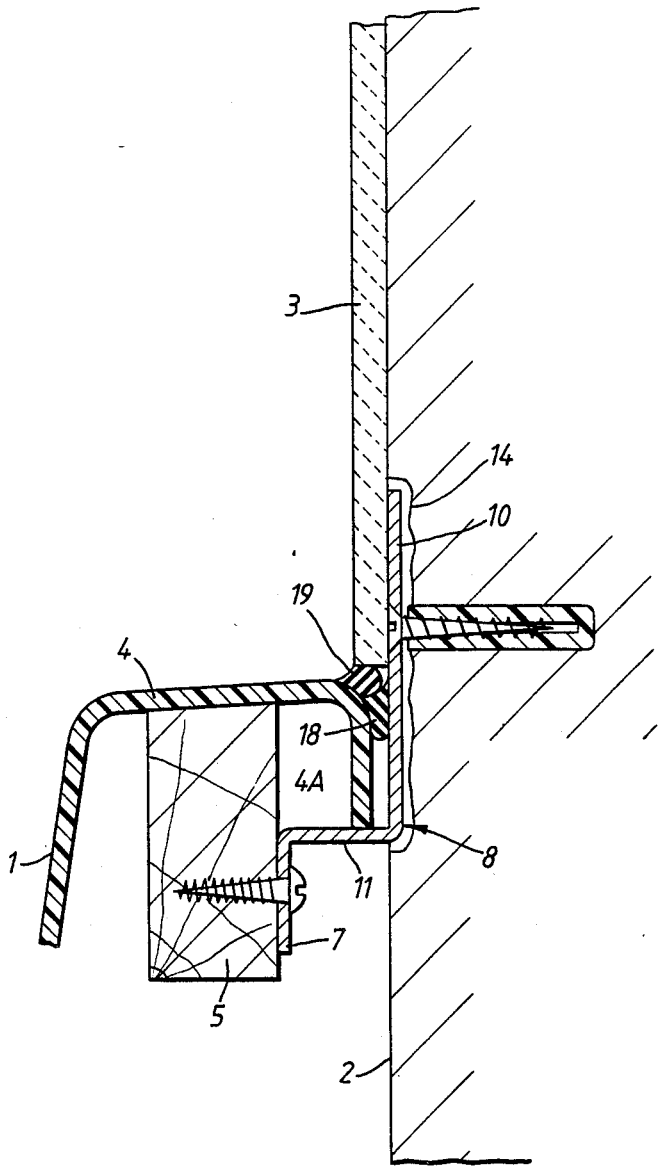
FIG. 1 shows schematically in section, a bath or shower-tray installation in accordance with the method of the present invention.

A bath or shower-tray 1, hereafter referred to as a bath, is shown installed against a wall 2, on the outer face of which, above the level of the bath, there is provided tiling 3 as the finished wall surface. Along the side of the bath which is to be against the wall, under the bath rim or roll 4, there is a wooden frame member 5 secured to the bath and to which is secured by screws, a downwardly projecting flange 7 of an aluminum strip 8 which extends longitudinally along the entire length of the side or edge of the bath 1.

The strip 8 is continuous and of uniform double-angled section, including an upwardly projecting flange or upstand 10 and a generally horizontal intermediate web portion 11 which, in the installation, bridges the gap between the frame member 5 and the wall 2. Further, similar strips, not shown, may be similarly mounted along one or more other edges of the bath if it is to be fitted against two or more mutually perpendicular walls. At the corners where adjacent ends of the strips 8 meet, they may be mitered.

For installation, the strip or strips 8 are screwed or otherwise secured to the bath frame 5, and then the bath is fitted up to the wall or walls 2. However, if the wall finish requires a flat surface, for example as shown for the tiling 3, the wall is first recessed slightly at 14 to take the thickness of the upstanding flange 10. This upstanding flange 10, which projects above the level of the bath roll 4, is then screwed to the wall at various points along its length, as needed, to obtain a rigid fixing and to suit the wall, e.g., so that the fixing points coincide with plasterboard supports. When secure, a sealing compound, such as a silicone, is run along between the bath 1 and the strip 8 to form a first seal 18, which is allowed to cure.

The tiling 3, or other wall covering, is then completed, a gap of approximately 3 to 4 mm being left between the lowest tile and the bath roll 4. This gap is subsequently caulked with further sealing compound to form a second, outer seal 19. In a corner position, a similar arrangement of seals 18 and 19 would be formed along the further side or sides against other walls, and sealant is also used at the corners of the installation to make the mitered joints watertight.

Figure 2:
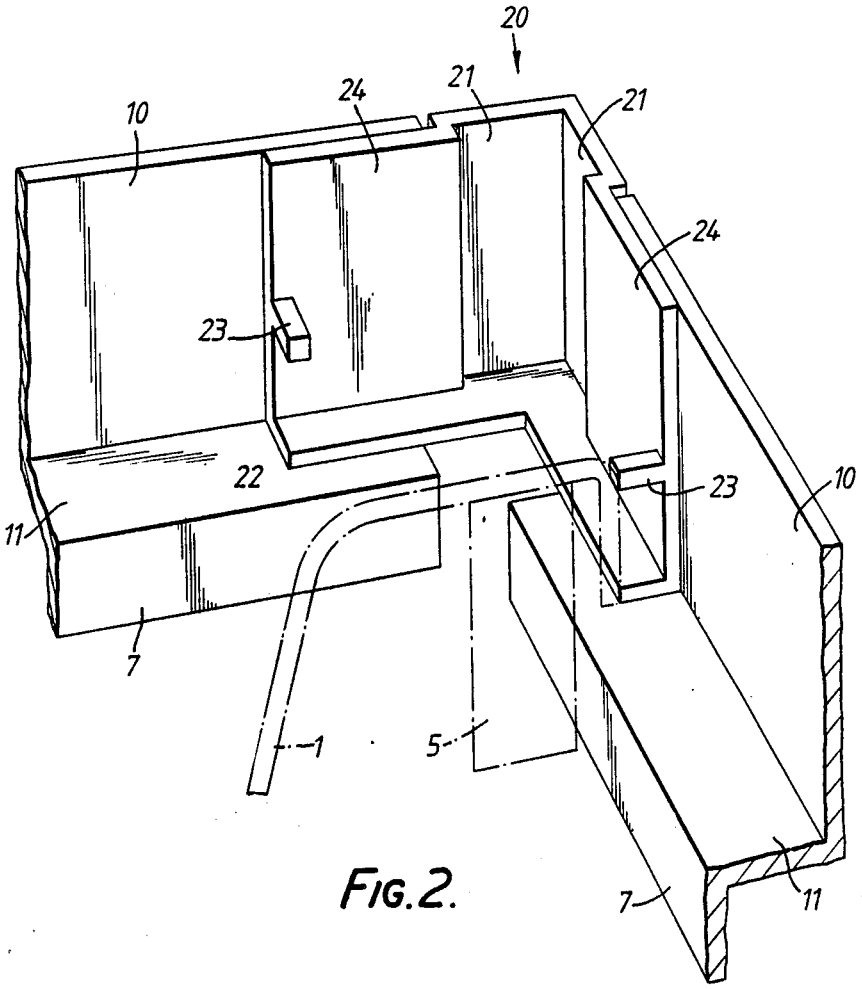
FIG. 2 shows an alternative corner arrangement.

An alternative to the use of mitered joints at the corners is to use a separate corner piece 20, as shown in FIG. 2. The ends of adjacent strips are simply left square and are abutted, or are located slightly apart, leaving a rectangular gap in the actual corner, and the bath is then affixed to the walls. Mastic is then put into the corner gap, and the plastics molded corner piece 20 pushed into the corner gap between the strip ends and the bath roll. The corner piece 20 comprises two mutually right-angled portions 21 which may be extended to include slightly stepped portions 24 which overlap by a small amount the upstands of the aluminum strips, and a web 22 at the bottom to support sealing compound which is subsequently applied. The stepped portions 24 and web 22 may be omitted or varied in other embodiments. The use of the corner piece 20 avoids the necessity for mitering the strip ends. Spacers 23 may be integrally molded to determine the correct position of the corner piece 20 in relation to the bath or tray.

It will be appreciated that the installation is quick and easy to carry out, yet provides a virtually guaranteed watertight edge seal which has not been possible with installation methods used up till now. With the present invention, there are two barriers preventing water penetration, provided by the first and second seals 18 and 19. Moreover, in actual use, the sealing action is enhanced. The weight of a user and/or the water in the bath tends to cause the bath edge 4A to press down on the horizontal portion 11 of the strip 8 which deflects slightly to an obtuse angle with the upstand 10. This has the effect of drawing the bath 1 nearer to the wall 2 and of compressing the seal 18. Also, any flexure of the bath under load would tend to cause the bath roll 4 to tilt and move the outer edge 4A outwards towards the wall, with the resulting same improved sealing action.

The upstanding flange 10 of the strip 8 has a certain lateral flexibility enabling it to be fastened to the wall 2 even if the latter is not truly flat along the extent of the bath edge.

The strip 8 need not be strong enough to support the bath if the latter is properly supported elsewhere, but normally the strip 8 will be sufficiently strong to adequately support part of the bath weight. Depending upon the strength requirements, the strip 8 could be made of plastics or of metal other than aluminum. The section of the strip 8 could also differ from that shown; it could simply be L-shaped with the horizontal limb located under the wooden or other material frame 5 and screwed or otherwise secured to it from underneath; or it could be J-shaped.

The strip 8 need not be of uniform continuous section throughout its length, for example the intermediate portion need not be continuous but the upstanding flange 10 should be continuous. The downward flange 7 could be in shorter sections than the complete length, e.g., in the form of wide tabs or a number of lugs.

In the place of one or both of the seals 18 and 19, a sealing strip could be used, although in practice since the gap to be sealed will almost inevitably be variable because the bath frames are not accurately positioned with respect to the bath edge, the use of a sealing element may be less practical.

The invention also embraces a bath or shower-tray when installed according to the method of the invention, and an installation kit comprising the bath or shower-tray together with one or more of the continuous strips for mounting it against one or more walls. Each strip in the kit may be provided overlength with one or both ends mitered so that the installer can simply cut one or both ends to suit the particular installation location, or strips of correct may be provided, with one or more corner pieces as mentioned above.

I claim:

1. A method of installation, in sealed relationship against at least one vertical wall, a bathing vessel of the type having a sump to contain water therein and a water drain outlet, the bathing vessel including a horizontal rim extending away from the sump and a depending skirt formed around the horizontal rim, said method comprising:

providing a frame assembly and positioning said sump of said bathing vessel therein;

supporting said bathing vessel along the upper surface of said frame so that said depending skirt lies adjacent said at least one vertical wall;

providing a sealing strip and positioning said strip between said depending skirt and said at least one vertical wall, said sealing strip having parallel extending flanges spaced from each other by a horizontal web;

mounting at least one of said flanges to its corresponding vertical wall and frame and establishing a gap between said wall and said horizontal rim, applying a first sealing compound to form a seal between said depending skirt and one of said opposed flanges and allowing said first seal to cure and subsequently applying an outer seal adjacent to said first seal in said gap between the wall and the horizontal rim so that any movement of said bathing vessel will shift said sealing strip and said sealing compound to maintain its sealing relation between said depending skirt and the at least one of said parallel flanges, thereby preventing water from penetrating below said rim of said bathing vessel wherein at least one of said flanges of said sealing strip nests in a recess formed in at least one of said vertical walls so that the outer surface of said plane and said wall are substantially coplanar.

* * * * *